US006925925B2

(12) United States Patent
Cäsar et al.

(10) Patent No.: US 6,925,925 B2
(45) Date of Patent: Aug. 9, 2005

(54) PISTON FOR A COMPRESSOR

(75) Inventors: Roland Cäsar, Stuttgart (DE); Jan Gärtner, Stuttgart (DE); Klaus-Dieter Mörgenthaler, Stuttgart (DE); Gunnar Rausch, Wildberg (DE); Jürgen Wertenbach, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 163 days.

(21) Appl. No.: 10/834,898

(22) Filed: Aug. 12, 2003

(65) Prior Publication Data

US 2004/0244579 A1 Dec. 9, 2004

Related U.S. Application Data

(63) Continuation-in-part of application No. PCT/EP02/01522, filed on Feb. 14, 2002.

(30) Foreign Application Priority Data

Feb. 14, 2001 (DE) ..... 101 07 424
Sep. 14, 2001 (DE) ..... 101 45 305

(51) Int. Cl.[7] ..... F04B 53/14
(52) U.S. Cl. ..... 92/12.2; 92/172; 92/248
(58) Field of Search ..... 91/499; 92/12.2, 92/71, 172, 248, 255, 258; 29/888.04, 888.042

(56) References Cited

U.S. PATENT DOCUMENTS 1,467,255 A 9/1923 Thomson
4,425,837 A 1/1984 Livesay
5,630,353 A 5/1997 Mittlefehldt et al.
5,868,556 A * 2/1999 Umemura ..... 92/71
5,941,161 A 8/1999 Kimura et al.
6,024,009 A * 2/2000 Morita ..... 92/12.2
6,324,960 B1 * 12/2001 Enokijima et al. ..... 92/71
6,557,454 B2 * 5/2003 Miyazawa ..... 92/71
6,575,080 B1 * 6/2003 Enokijima et al. ..... 92/71

FOREIGN PATENT DOCUMENTS

| | | |
|---|---|---|
| DE | 34 31 586 | 4/1985 |
| DE | 36 07 497 | 9/1997 |
| DE | 197 54 028 | 6/1998 |
| DE | 197 46 896 | 7/1998 |
| EP | 0 945 615 | 9/1999 |
| EP | 1 022 463 | 7/2000 |
| EP | 1 055 817 | 11/2000 |
| JP | 07 189897 | 7/1995 |
| JP | 09 053563 | 2/1997 |

* cited by examiner

*Primary Examiner*—Thomas E. Lazo
(74) *Attorney, Agent, or Firm*—Klaus J. Bach

(57) ABSTRACT

In a piston for a compressor, the piston comprises a stem by which the piston may be guided in the housing in an axially displaceable manner, and a force introducing section where an outer drive force can be introduced into the piston. The piston head, the piston skirt and the force introducing section are successively arranged in the direction of the piston axis. The piston head, the piston skirt and the force introducing section are produced as a single element of graphite or a synthetic material, and the piston skirt comprises a solid strut structure and a guide section, the cross-sectional area of the strut structure being smaller than the surface of the piston head. The piston consists of a non-organic, non-metallic material having an average thermal expansion of less than $7\times10^{6}$/° C. in the temperature range of 0° C. to 200° C.

18 Claims, 3 Drawing Sheets

PISTON FOR A COMPRESSOR

This is a continuation-in-part application of international application PCT/EP02/01522 filed Feb. 14, 2002 and claiming the priority of German applications 101 07 424.7 filed Feb. 14, 2001 and 101 45 305.1 filed Sep. 14, 2001

BACKGROUND OF THE INVENTION

The invention relates to a piston for a compressor with a piston stem for guiding the piston and a piston engagement section where a drive force can be applied to the piston to move the piston in an axial direction and a piston stem for transferring the drive force to the piston head.

In air-conditioning systems for motor vehicles, axial piston compressors are used to compress coolants, wherein so-called swash plates serve as force transmission elements between the drive shaft and the pistons. The compression generally takes place through periodic movement of the pistons in the cylinders, whereby the coolant is sucked in, compressed and expelled. The axial movement of the piston is generated by the swash plate, which is connected to the rotating shaft of the compressor and encloses an angle between approximately 60° and 90° with the axis of rotation. The rotational movement results in a reciprocating movement at the pistons. A shoulder of each piston engages the swash plate, which thus transmits the reciprocating movement to the piston and converts the shaft rotation to an oscillating movement of the piston. Up until now, pistons are assembled from two parts in order to form a hollow configuration. It is necessary to guide the pistons and provide for a small oscillating mass. A quantity of lubricant, which is introduced into the coolant, is used to lubricate the pistons and the drive shaft of the compressor. With coolants such as R134*a*, the lubricant is circulated continuously with the coolant. With coolants such as $CO_2$, a lubricant precipitator separates the lubricant from the coolant downstream of the compressor. The lubricant is then again returned to the compressor for lubrication.

In DE 197 46 896 A1, a compressor with pistons for compressing a gas is described in which the rotation of a drive shaft can be converted into linear reciprocal movement of the piston by means of drive elements such as swash plates. The object here is to minimize the weight of the pistons by reducing the material without adversely affecting the function of the sealing the compression chamber and the compression of the gas in the chamber. For this purpose, the piston has, in the region of the compression chamber, two areas, which are continuously in contact with the cylinder cavity and thus seal the chamber. Furthermore, the piston has a space, which opens to the cylinder cavity of the piston, the space being located between the second face and the apron, which transmits the movement of the swash plate to the pistons. However, when transverse forces occur, the piston is not guided satisfactorily in the cylinder cavity.

DE 197 54 028 A1 discloses a piston for a compressor with the same function as described mentioned above which is distinguished by two radial recesses which are offset by an angle of 180° between the sealing face of the sealing chamber and the apron in the circumferential face in order to reduce its weight. When there are transverse forces in the cylinder cavity, it is possible to guide the piston as a function of the direction. However, the loads on the cylinder cavity walls and piston are not homogeneously distributed, as a result of which increased wear can occur. Furthermore, the piston has, for fabrication reasons, a face extending over the entire cylinder cavity between the two recesses, which is without function and thus only increases the weight.

U.S. Pat No. 5,630,353 describes a piston corresponding to the above function, which piston is distinguished by ribs arranged in a star shape underneath the piston head and the necessary seal of the compression chamber in order to reduce the weight. These ribs are radially deformed and accordingly when transverse forces occur they do not provide for guidance over the complete circumference of the cylinder.

EP 1 022 463 A2 describes a piston according to the above-mentioned function which is manufactured from two parts made of different materials. Here, the apron is composed of metal and is joined, in a shaping process, to the cylindrical body, which closes off the sealing chamber. The body finally receives its shapes in this method. The connection of the two bodies takes place by means of a small hook on the apron, which is surrounded by the material of the cylindrical body. A disadvantage of this solution is the fact that the entire axial tensile force, which acts on the piston, has to be transmitted by the connection between the apron and cylindrical body.

EP 0 945 615 A2 also discloses a compressor piston which has a piston head for compressing a medium, a piston stem for axially guiding the piston in a housing and a force application section for applying an external drive force to the piston. The piston head, piston stem and force application section are arranged one behind the other in the direction of the piston, the piston stem having a strut which is oriented in parallel with the piston axis and has a W-shaped cross section. The shaping which is indicated here permits a reduction in weight even when a metallic material is used.

U.S. Pat. No. 5,941,161 finally also discloses a piston for a compressor which has a piston head for compressing a medium, a piston stem for axially guiding the piston in a housing and an engagement section for applying an external drive force to the piston. The piston head, piston stem and engagement section are arranged one behind the other in the direction of the piston axis, the piston stem having a solid strut, which is oriented in parallel with the piston axis. U.S. Pat. No. 5,941,161 discloses various shapes of such a strut which can be implemented with an aluminum alloy.

It is the object of the invention to provide a piston, which has a particularly low weight, is easy to manufacture and permits a particularly simple design and operation of the compressor.

SUMMARY OF THE INVENTION

In a piston for a compressor, the piston comprises a stem by which the piston may be guided in the housing in an axially displaceable manner, and a force introducing section where an outer drive force can be introduced into the piston. The piston head, the piston skirt and the force introducing section are successively arranged in the direction of the piston axis. The piston head, the piston skirt and the force introducing section are produced as a single element of graphite or a synthetic material, and the piston skirt comprises a solid strut and a guide structure, the cross-sectional area of the strut being smaller than the surface of the piston head. The piston consists of a non-organic, non-metallic material having an average thermal expansion of less than $7\times10^{-6}/°$ C. in the temperature range of 0° C. to 200° C.

The inventive piston specifically includes a piston stem which serves to connect the piston head and force application section, which is formed so as to stiffen the piston overall and to set the distance between the piston head and force application section (dimensioning of the piston). The piston is also distinguished by a piston stem, a piston head and a force application section, which are manufactured in one piece from an inorganic and nonmetallic substance, the substance having an average thermal expansion of less than $7*10^{-6}/°$ C. in the temperature range between 0° and 200° C. This piston stem is solid, i.e. of non-hollow configuration so that be fabricate in a simple and inexpensive manner. In one embodiment, one or more solid struts preferably extend over the greater part of the piston stem, the struts together forming an arrangement with a preferably non-round cross-sectional area whose circumference corresponds approximately to the circumference of the piston head. As a result, linear contact faces (sliding faces) are produced between the piston stem and the surrounding housing and these provide, with the particular selection of material, for favorable sliding properties under all operating conditions.

In one embodiment of the invention, a strut is provided with a cross-section which is V-shaped, U-shaped, M-shaped or W-shaped or wave-shaped in some other way (in a transverse cross-section with respect to the piston axis). The shape of the strut, which is curved with respect to the piston axis, results in a high degree of rigidity in the longitudinal direction of the piston and, simultaneously, a low weight. In addition, one-piece manufacture of the piston head, piston stem and piston engagement area is advantageously provided.

In a further embodiment of the invention, the piston stem has at least one disk-shaped guide area whose cross-sectional area corresponds in shape and size at least approximately to the area of the piston head. The guide area serves in particular to support the piston in the surrounding cylinder housing and extends parallel to the piston head. The guide area has a preferably round to elliptical cross section. The guide area is connected to the piston head via one or more struts, and its height is small with respect to the length of the struts or with respect to the length of the piston stem. The external (circumferential) face of the guide area forms a slide support face, which slides along the surrounding cylinder housing. The guide area is preferably connected over an approximately central axis to the piston head, the external (circumferential) faces of the guide area forming, together with the outer (circumferential) face of the piston head, a uniform, geometrically interrupted slide support area which slides along the surrounding housing.

In a further embodiment of the invention, the piston stem comprises a plurality of rib-shaped, radially extending struts. The struts preferably have over their axial length a constant thickness, which decreases radially outwardly.

In still a further embodiment of the invention, the rib-shaped, radially extending struts are arranged in a star shape about a core. In particular, three or more struts are provided.

In another embodiment of the invention, at least one strut has a radially externally located slide face for guiding the cylinder in the housing. The slide face slides along the surrounding housing, and is consequently preferably configured to be as small as possible, a material pairing of graphite and metal provides for particularly low-friction.

In still another embodiment of the invention, the piston stem has a plurality of struts which are arranged distributed asymmetrically and/or non-uniformly in accordance with an engagement force effective outside the piston axis. The struts are preferably concentrated in the region of the greatest application of force around the piston axis. In this way, the piston can be adapted particularly well to the loading and can be configured with relatively low weight.

In a further embodiment of the invention, the piston stem has a tubular guide area, which has an at least partially cylindrical outer surface and which at least partially encloses the strut. The guide area forms a (first) hollow shape which extends in the direction of the main axis of the piston (slide direction) and which surrounds an internal strut from a plurality of sides, i.e. over an angular range of the piston of >180° (to be considered in the direction of the main axis of the piston) at a distance. As a result, a comparatively large contact face is provided, which can be dimensioned according to requirements, for generating relatively low contact pressure between the piston and a guide cylinder.

In a refinement of the invention, a pocket which is open on the side of the guide area facing away from the piston head and has an approximately sickle-shaped cross-sectional area, which is oriented transversely with respect to the piston axis is formed between the tubular guide area and the strut. The side of the guide area, which faces away from the piston head, points in the direction of the force application area. It can be beveled for reasons of weight and friction control. The other side of the force application section preferably adjoins the piston head directly.

In a further refinement of the invention, a recess or notch which runs along the piston axis, has an approximately constant cross section and preferably has an angle of aperture of 20° to 120°, in particular approximately 45°, is provided in the cylindrical guide section. The recess forms a negative structure, which is held in the tubular guide section. In accordance with the angle of aperture of the recess, on one hand, the external surface of the guide section can be dimensioned and, on the other hand, the mass of the piston can be varied. The lowest point of the notch is preferably arranged in the vicinity of the piston axis and is of rounded configuration for reasons of stability and fabrication.

In still a further embodiment of the invention, the piston according to the invention is distinguished by a piston stem, a piston head and a force application section, which are manufactured monolithically from a graphite, in particular a fine-grain graphite, without structural cavities. All the parts form a monolithic part, i.e. they do not have any structural cavities—provided with undercuts—with a linear extent of more than 1 mm.

In a further refinement, cutouts, which have an average diameter of 0.1 $\mu$m to 1 mm, are provided in the manner of a network. An open-pore piston body with cavities with an average diameter also of the size of 0.1 $\mu$m to 1 mm is formed. The guide surfaces preferably also have recesses with an average diameter of 0.1 $\mu$m to 1 mm in the depth and in the surface extent. The pore volume can be up to 50% of the overall volume. The proposed refinement permits an air-conditioning system compressor to operate with minimum lubrication or without the addition of lubricants. Friction is reduced effect by the fact that operating substances are held and supported in the recesses and by the fact that the recesses also have a supplementary function as a reservoir for abraded substances (preferably of the graphite piston).

In a further refinement of the invention, the surfaces of the piston, and at least the external guide faces, are provided with an organic, inorganic or metallic coating such that the geometric surface structure formed by recesses with an average diameter of the size of 0.1 $\mu$m to 1 mm in depth and in the surface extent, is still largely formed or retained. The thickness of the layer must be selected such that the function of the recesses—holding and buffering operating substances (gases and fluid) of the compressor and as a reservoir for abraded substances, preferably of the piston—is maintained.

In a particular embodiment of the invention, the engagement area has a shoulder, which extends around a force application means. A swash plate, which is attached to a rotating axle in an inclined arrangement and converts a rotational movement of the drive shaft into a translatory movement, is provided as engagement means. The engagement area is configured in such a way that it engages in an optimum way the force application means for transmitting the forces into the piston, and it preferably has a U-shaped shoulder and is equipped with sockets for sliding blocks or similar bearing elements.

The piston according to the invention may include a force application area to which a reinforcement element in the form of a U-shaped, L-shaped and/or hook-shaped inlay is assigned. The inlay is provided in particular for reinforcing the force application section or its shoulder as the force application section or its shoulder are highly loaded components. The inlay is at least partially surrounded by the force application area but can extend through the entire piston. As a result, the remaining part of the piston can be formed by a particularly light material.

In a further refinement of the invention, the inlay of the force application section consists of another material, in particular a metal. The toughness of the metallic inlay ensures improved stability of the piston.

The invention will become more readily apparent from the following description of exemplary embodiments described on the basis of the accompanying drawings.

DETAILED DESCRIPTION OF PREFERRED EMBODIMENTS

Figure 1:
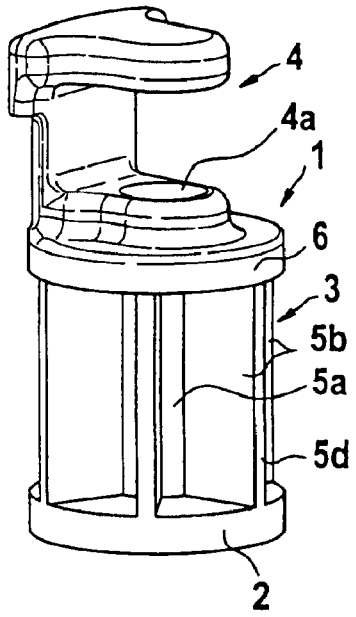
FIG. 1 is a schematic representation of a piston according to the invention for a compressor.

FIG. 1 is a perspective illustration of a piston 1 for a coolant compressor of a motor vehicle air conditioning system. The piston 1 comprises a piston head 2, a piston stem 3 and a force application or engagement section 4. A plurality of such pistons are arranged in a circular array around a rotatable drive shaft in a housing of the coolant compressor, all the piston axes being oriented in parallel with one another and in parallel with the drive shaft. Each piston is guided independently in an essentially cylindrical bore of the housing (cylinder) in which it can move in a translatory and if appropriate also rotary fashion. The cylinders open into a common working chamber through which the coolant is conducted. The coolant is compressed by periodic movement of the pistons in the cylinders. The coolant is sucked in, compressed and expelled. The upward and downward movement of the piston is generated by a force application means in the form of a so-called swash plate which is connected to the rotating drive shaft of the compressor and has a preferably variable angle between approximately 60° and 90° with the axis of rotation. The rotary movement of the drive shaft is transformed into a reciprocating movement of the pistons by means of the swash plate. The force application section 4 of the piston 1 comprises a piston shoulder, which extends around the swash plate and thus transmits the reciprocating movement to the piston. Sockets 4*a* in which sliding shoes formed from a ceramic material (not illustrated) pivotably mounted for the sake of angular compensation are provided in the piston shoulder 4. During operation the sliding shoes slide along the swash plate around which they extend for engagement therewith.

The further design of the coolant compressor is of no significance for the present invention, and for this reason, no detailed illustration is given at this point. However, details can be gathered from DE 197 49 727 A1, or from U.S. Pat. No. 6,024,009 which is incorporated in the description by reference.

The external diameters and the corresponding outlines of the piston head 2, piston stem 3 and force application section 4 are slightly smaller than the diameter of the cylinder so that the piston can be displaced with a certain degree of play within the cylinder. In the embodiment of FIG. 1, the piston stem 3 serves the purpose, together with the piston head 2, of being guided in the cylinder in order to avoid tilting. Optionally, at least one piston ring is installed in the region of the piston head 2 in order to avoid compression losses (cf. also FIG. 3). In a modified exemplary embodiment, the piston head and piston stem have elliptical cross sections.

The piston 1 is a one-piece design and largely formed without structural cavities, i.e. solidly, a preferably fine-grain graphite being provided as the material for manufacturing the piston. In a modified exemplary embodiment, the graphite is reinforced with carbon fibers or glass fibers, the fibers being preferably arranged in such a way that optimum rigidity is achieved in the loading direction. The piston can be coated or provided throughout or at its contact faces and/or its slide surfaces with a carbon-containing ceramic (carbide) and/or a nitrogen-containing ceramic (nitride). The use of such low-density materials permits a considerable reduction in weight in comparison with known piston structures, the necessary component stability being ensured by the geometry of the piston. The piston can be cast in one piece, pressed and/or sintered. In one modified exemplary embodiment, the piston is manufactured from a plastic, which may be fiber-reinforced.

The piston preferably comprises a piston stem 3, a piston head 2 and a force application section 4, which are manufactured from a fine-grain graphite, in particular by sintering, in less than 60 hours from a mesophase powder (hard burnt) carbon which is then graphitized at temperatures between 1800 and 3000° C. and has a flexural strength of preferably >80 MPa. All the parts are monolithically configured in such a way that simple fabrication is possible. The graphite used preferably has a pore volume component of 16 to 50 Vol. %. This pore volume component is obtained automatically if a graphite with a pore structure having a pore component between approximately 6 and 16% is used.

When the surfaces of the piston are machined, pores are cut so that depressions and recesses are formed in the surface, in particular in the region of the sliding surface.

Figure 4:
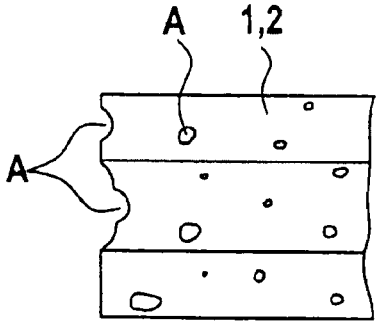
FIG. 4 is a schematic view of a section of a further exemplary embodiment of the piston according to the invention in accordance with FIG. 1 with recesses in the surface.
Figure 5:
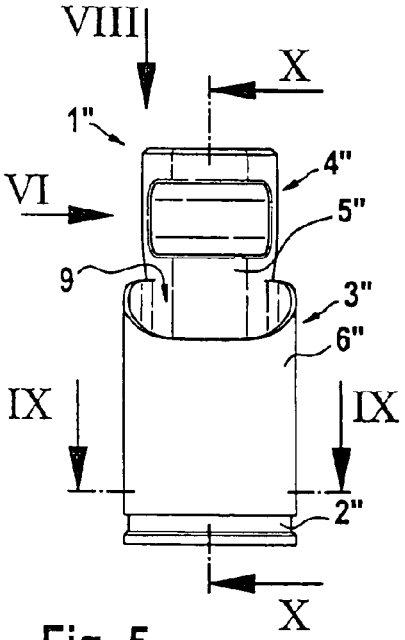
FIG. 5 is a first view of a fourth exemplary embodiment of the piston according to the invention.
Figure 6:
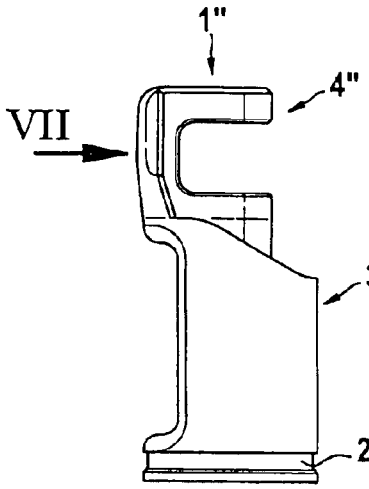
FIG. 6 shows the piston according to FIG. 5 in the direction of the arrow VI.
Figure 7:
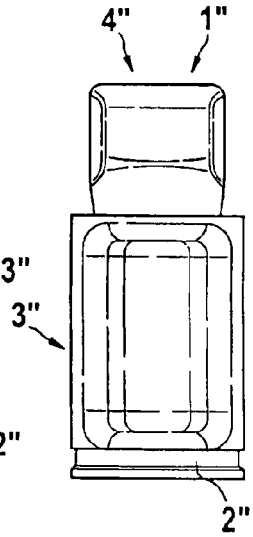
FIG. 7 shows a piston according to FIG. 5 in the direction of the arrow VII.
Figure 8:
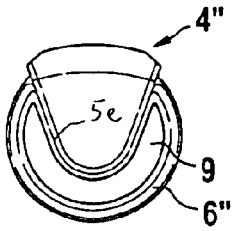
FIG. 8 shows the piston according to FIG. 5 in the direction of the arrow VIII.
Figure 9:
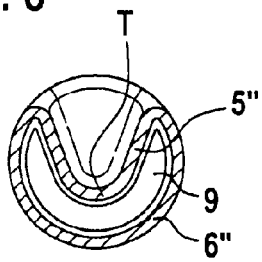
FIG. 9 is a cross-sectional view of the piston according to FIG. 5 in the direction of the arrows IX—IX, FIG. 10 a cross-sectional view of the piston according to FIG. 5 in the direction of the arrows X—X
Figure 10:
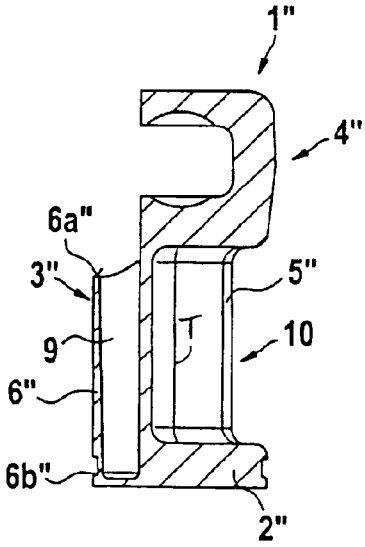
Figure 11:
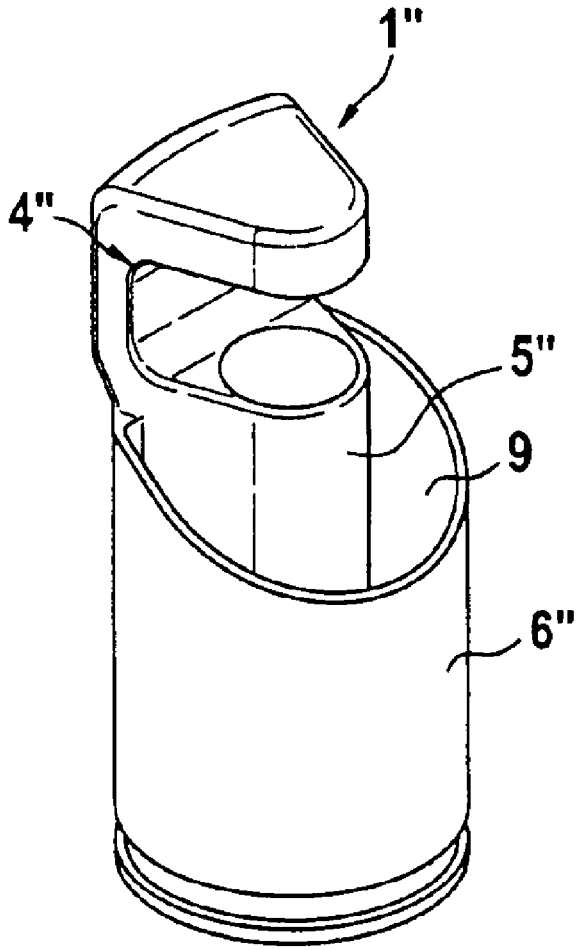
FIG. 11 shows a perspective view of the piston according to FIG. 5.

In one particular embodiment, all the surfaces and at least the external guide surfaces, are provided with recesses A with an average diameter of the size 0.1 μm to 1 mm in depth and in the surface extent (see FIG. 4). These are preferably generated by mechanical exposure of pores (present in the piston material, graphite or plastic) with the aforesaid size (see above), but can also be generated by mechanical machining, by laser or by other chemical treatment or physical erosion processes. These recesses have in particular the purpose of holding and buffering operating substances (fluids) of the compressor and also as a reservoir for wear substances preferably of the piston, this wear material being suitable as a lubricant, but at least as a lubricant during operation with insufficient normal lubricant.

The above-mentioned recesses and cavities with an average diameter of the size of 0.1 μm to 1 mm are preferably filled during manufacture and/or during operation with metals or metallic alloys, preferably metals and alloys with a specific weight of less than 5 g/cm$^3$ which are removed from the surface, preferably from the slide surfaces, mechanically, chemically or physically to such an extent that recesses A with an average diameter of 0.1 μm to 1 mm in depth and in surface extent are produced.

Figure 2:
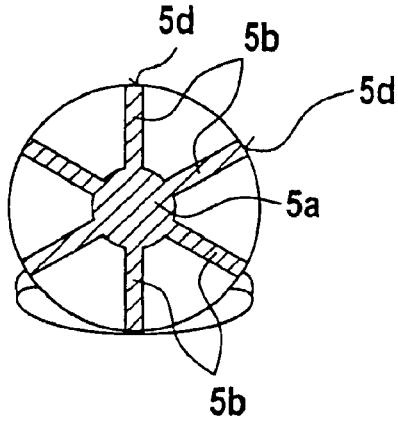
FIG. 2 is shows section perpendicularly to the piston axis through the piston according to FIG. 1.

In the exemplary embodiment according to FIG. 1 and FIG. 2, the piston stem 3 includes the solid strut 5*a* which extends centrally, along the piston axis, as well as six rib-shaped, radially extending struts 5*b*, and a plate-shaped guide section 6. The struts 5*a*, 5*b* are narrow in comparison with the diameter of the piston stem 3. The guide section 6 is flat in comparison with the height of the entire piston stem 3 and in comparison with the length of the struts 5*a*, 5*b*. The struts 5*b* are arranged uniformly in star shapes about the central strut 5*a*. The cross section of the piston stem in the region of the struts 5*a*, 5*b* is thus noncircular, the outline corresponding approximately to the circumference of the piston head. The struts 5*b* have, at their radially outer ends, narrow slide faces 5*d* which can contact the cylindrical surface of the compressor housing (cylinder) in order to guide the piston. The slide faces 5*b* form, together with the outer (also cylindrical) surfaces of the guide section 6 and piston head 2 with which they are continuous without a step, a uniform contact surface between the piston and cylinder.

In modified exemplary embodiments, any desired number of radially extending struts may be arranged about a central strut. Either a symmetrical or an asymmetrical distribution of the radially extending struts can be provided, there being preferably a non-uniform, asymmetrical distribution in accordance with the loading of the piston during operation. It is also possible to omit a central strut.

In further modified exemplary embodiments, a plurality of struts are embodied as individual pillars which are oriented in parallel with the piston axis. A plurality of struts which stand alone are preferably arranged along the circumference of the piston stem, one or more struts having a curved sliding surface or contact surface between the piston and cylinder.

The U-shaped force application section 4 may have an inlay, which is preferably U-shaped or L-shaped. In one modified exemplary embodiment, the inlay is of hook-shaped configuration and extends, on the one hand, through the entire force application section and, on the other hand, through the central strut 5*a* of the piston stem. The inlay is manufactured in one piece from a material with high rigidity, high toughness and/or stiffness, in particular from an aluminum alloy or steel alloy. It is added to the piston material during the manufacture of a piston 1, forms a permanent connection with the piston and can not be disconnected. The inlay can be coated with plastic on all sides, partially or on one side. The remaining part of the piston is in one piece—except for the inlay. In one modified exemplary embodiment, the inlay lies in the region of the sockets in order to support the sliding structure on the external surface of the piston. Such an inlay achieves increased rigidity of the overall piston structure, in particular highly loaded regions can be reinforced.

Figure 3:
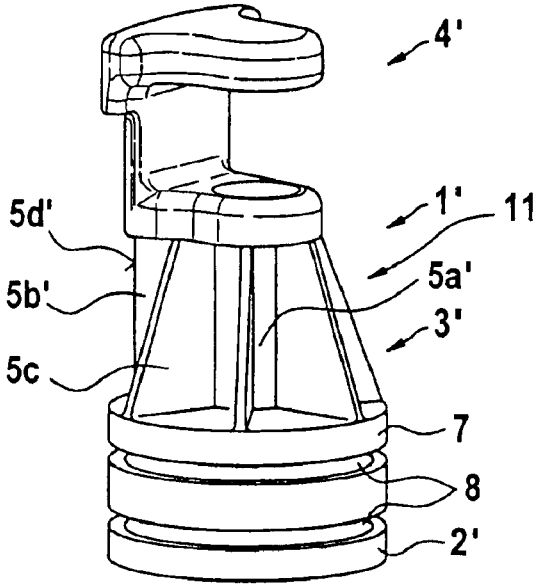
FIG. 3 shows a modified exemplary embodiment of the piston according to FIG. 1.

In the exemplary embodiment according to FIG. 3, a lower part 7 of the piston stem 3' of a piston 1' is of cylindrical construction in the same way as the piston head 2' so that, in this region, it is ensured that the piston 1' is guided on all sides in the cylinder. Optionally, circumferential grooves 8 are provided for one or more piston rings. In an upper part of the piston stem 3', whose length is significantly greater than the length (=height) of the lower part 7, a central strut 5*a'* and a rib-like strut 5*b'* are provided, said rib-like strut 5*b'* extending in the radial direction and having an external running face 5*d'* in the direction of the piston axis. The strut 5*b'* is used, on the one hand, to support the piston on the surface of the cylinder in which it is guided and on the other hand to stiffen the piston 1' in that region in which the force application section 4' has a large lever arm with respect to the piston axis. Further, sloping struts 5*c* are provided without sliding surfaces by means of which the force application section 4' is supported and the piston 1' is stiffened overall.

When a piston according to the invention is used in a coolant compressor of a motor vehicle air conditioning system, it is possible to dispense with adding lubricant (oil) to the coolant, which is necessary in known compressors for lubricating the pistons. Consequently, it is also not necessary to provide a lubricant separator for cleaning the coolant. Local lubrication with grease is provided on components of the compressor where continuous lubrication is still necessary.

Without lubricant added to the coolant, there is, on the one hand, no negative influence on the thermodynamic properties of the coolant, which is unavoidable with the addition of lubricant. On the other hand, it is possible to dispense with an oil circuit for lubricating the compressor with all its components. Finally, without a lubricant added to the coolant there is no need for an (additional) hazardous substance, which is toxic to humans. For example, if the coolant circuit, in particular the compressor, has a leak so that coolant can escape from the coolant circuit, there is no additional danger resulting from a lubricant.

A further preferred exemplary embodiment of a piston 1" according to the invention is illustrated in FIGS. 5 to 11. The piston can be formed either from a fine-grain graphite or from some other material such as magnesium, aluminum, ceramics etc.

Here, the piston stem 3" has a tubular guide section 6" which has an at least partially cylindrical outer surface and which extends at least partially around a strut 5". The guide section 6" forms a (first) cavity which extends in the direction of the main axis of the piston (running direction) and which surrounds, at a distance, the internal strut 5" from a plurality of sides, i.e. over an angular range, (the main axis of the piston) of the piston of more than 300°. As a result, a pocket 9 which is open on the side of the guide section which faces away from the piston head 2", with an approximately sickle-shaped cross-sectional area orientated transversely with respect to the piston axis is formed between the tubular guide section 6" and the strut 5" (see in particular FIG. 9). The end 6*a*" of the guide section 6" which faces away from the piston head points in the direction of the force application section 4" may be sloped to reduce weight and friction. The other side 6*b*" of the force application section preferably directly adjoins the piston head 2" (cf. FIG. 10).

The strut 5" has, as is apparent from the cross-sectional view (FIG. 9), a wave-configuration, in particular an approximately V-shaped profile in the transverse direction of the piston, and merges seamlessly with the guide section 6" in the circumferential direction. As a result, sufficient rigidity, accompanied by a simultaneously extremely small mass of the piston stem 3", is obtained in the longitudinal direction of the piston. In modified embodiments, the strut 5" may be corrugated differently, in particular configured in a U-shape, M-shape or W-shape.

As already described, a pocket 9 which is open at the end remote from the piston head is formed between the strut 5" and guide section 6". Also, at the side of the strut 5" opposite the pocket 9, a recess 10 is formed which has, in the direction of the piston axis, an approximately constant cross section, which corresponds to the wave profile of the strut 5". The recess 10 preferably has an angle of aperture of 20° C. to 120° C., in particular approximately 45°. The recess forms a (second) negative cavity, which is accommodated in the tubular guide section 61" and corresponds to the pocket 9. In accordance with the angle of aperture of the recess, on one hand, the external surface of the guide section can be dimensioned, and on the other hand the mass of the piston can be varied. The deepest point T of the recess 10 (corresponding to the valley of the wave profile of the strut 5") is preferably arranged in the vicinity of the piston axis and is of rounded construction for reasons of stability and fabrication.

As a result of the guide section 6", a comparatively large contact face, which can be dimensioned according to requirements, is provided between the piston and a guide cylinder, whereby reduced compressive loads per unit area are achieved.

What is claimed is:

1. A piston (1) for a compressor, in particular a coolant compressor of an air-conditioning system, comprising:

a piston head (2) by means of which a medium can be compressed, a piston stem section (3) extending from the piston and guiding the piston in an axially displaceable fashion in a cylinder housing, and a force application section (4) for the application of a drive force to the piston head (2), said piston head (2), said piston stem (3) and said force application section (4) being arranged one after the other in the direction of the piston axis, said piston stem (3) having a solid strut structure (5*a*, 5*b*) oriented in the direction of the piston axis and having a cross-sectional area smaller than the area of the piston head (2), and said piston stem (3), said force application section (4) and said piston head (2) being formed integrally from a nonorganic and nonmetalic material having an average thermal expansion of less than $7*10^{-6}/°$ C. in the temperature range between 0° C. and 200° C.

2. The piston as claimed in claim 1, wherein the strut structure (5*e*) has a cross section which is one of V-shaped, U-shaped, M-shaped, W-shaped and wave-shaped in a cross-section transversely with respect to the piston axis.

3. The piston as claimed in claim 2, wherein the piston stem (3") has a tubular guide section (6") which has an at least partially cylindrical outer surface and which at least partially encloses the strut (5").

4. The piston as claimed in claim 3, wherein a pocket, which is open at the end of the guide section remote from the piston head (2) and has an approximately sickle-shaped cross-sectional area which is oriented transversely with respect to the piston axis, is formed between the tubular guide section (6") and the strut (5").

5. The piston as claimed in claim 3, wherein a recess is formed by said strut 5" which extends along the piston axis and has an approximately constant cross-section with an angle of aperture of 20° to 120°, in particular approximately 45° C.

6. The piston as claimed in claim 1, wherein the piston stem (3) has at least on plate-shaped guide structure (6) which is spaced from the piston head (2) and whose cross-sectional area corresponds in shape and size at least approximately to the area of the piston head (2).

7. The piston as claimed claim 1, wherein the piston stem (3) comprises a plurality of rib-shaped, radially extending struts (5*b*, 5*c*).

8. The piston as claimed in claim 7, wherein the rib-shaped radially extending struts (5*b*, 5*c*) are arranged in a star shape about a core strut (5*a*).

9. The piston as claimed in claim 1, wherein at least one strut (5*b*, 5*b*') has a radially externally located sliding surface (5*d*) for guiding the cylinder (1, 1') in the cylinder housing.

10. The piston as claimed in claim 1, wherein the piston stem (3) comprises a plurality of struts (5*b*, 5*b*', 5*c*) which are arranged distributed asymmetrically and non-uniformly in accordance with an application of force effective outside the piston axis.

11. The piston as claimed in claim 1, wherein the piston stem (3), the force application section (4) and the piston head (2) are embodied monolithically without structural cavities from a fine-grain graphite.

12. The piston as claimed in claim 11, wherein the slide surface of the guide section (6) and of the slide surface of the piston has openings whose spatial extent is between 0.1 $\mu$m and 1 mm, the graphite of which the piston consists preferably having a pore component of 16 to 50 vol. %.

13. The piston as claimed in claim 12, wherein the external guide faces of the piston are provided with one of an organic, inorganic and metallic coating providing for the geometric surface structure with said openings.

14. The piston as claimed in claim 1, wherein the force application section (4) has a shoulder for engaging a force application means.

15. The piston as claimed in 1, wherein a reinforcement element is incorporated in the force application section (4).

16. The piston as claimed in claim 15, wherein said reinforcement element is an inlay in the force application section (4) and is constructed from a material other than said piston.

17. The piston as claimed in claim 16, wherein said reinforcement element consists of a metallic material.

18. The piston as claimed in claim 15, wherein said reinforcement element is in the form of one of a U-shaped, L-shaped and hook-shaped inlay.

* * * * *